US007628044B2

(12) United States Patent
Kopyrin et al.

(10) Patent No.: US 7,628,044 B2
(45) Date of Patent: Dec. 8, 2009

(54) SPIRAL VANE CLOTHES MOVER

(75) Inventors: Viktor N. Kopyrin, Dearborn, MI (US); Raveendran Vaidhyanathan, St. Joseph, MI (US); Flavio Bernardino, St. Joseph, MI (US); Robert J. Pinkowski, Baroda, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 734 days.

(21) Appl. No.: 11/209,370

(22) Filed: Aug. 23, 2005

(65) Prior Publication Data

US 2007/0044520 A1 Mar. 1, 2007

(51) Int. Cl.
*D06F 17/10* (2006.01)

(52) U.S. Cl. ..... 68/134

(58) Field of Classification Search ..... 68/134
See application file for complete search history.

(56) References Cited

U.S. PATENT DOCUMENTS 1,580,778 A * 4/1926 Coverstone ..... 68/133
1,615,952 A * 2/1927 Nelson ..... 68/92
1,627,931 A 5/1927 Schroeder
1,665,959 A 4/1928 Graham et al.
1,748,442 A * 2/1930 Davis ..... 68/134
1,764,476 A 6/1930 Smith et al.
1,810,047 A * 6/1931 Hersh ..... 68/134
2,478,188 A * 8/1949 Gibson ..... 8/159
2,516,655 A 7/1950 Smith
2,596,980 A * 5/1952 Castner ..... 68/54
2,612,768 A * 10/1952 Castner ..... 68/21
2,659,226 A * 11/1953 Pellerin ..... 68/133
2,677,260 A * 5/1954 Castner ..... 68/131
2,753,708 A * 7/1956 Ashby ..... 68/190
2,824,437 A * 2/1958 Reisch ..... 68/15
2,968,174 A * 1/1961 Bell et al. ..... 68/23.6
3,082,616 A * 3/1963 Ohlson ..... 68/134
3,095,721 A 7/1963 Bochan (Continued)

FOREIGN PATENT DOCUMENTS

JP 54-149270 * 11/1979

(Continued)

*Primary Examiner*—Frankie L Stinson
(74) *Attorney, Agent, or Firm*—Clifton G. Green; McGarry Bair P.C.

(57) ABSTRACT

An automatic washer for washing garments comprises a wash basket with an open top defining a wash chamber, and a clothes mover mounted in the washer for reciprocal movement about an axis of rotation within the wash chamber. The clothes mover comprises an apron, and at least one vane extending from the apron and defining a working surface having an upper edge and a lower edge, the upper edge and the lower edge extending from an outer end to an inner end. At least one line lying along the working surface and extending between the outer end and the inner end defines a constant angle of attack relative to the direction of movement of the clothes mover. The working surface is configured to move the garments along the working surface at a substantially instantaneously uniform speed. The configurations of the upper surface and the working surface are optimized to move the garments between the perimeter and the axis of rotation while minimizing force acting on the working surface. The working surface defines a local draft angle that increases from the outer end to the inner end.

77 Claims, 14 Drawing Sheets

U.S. PATENT DOCUMENTS

| | | | | |
|---|---|---|---|---|
| 3,943,736 | A | 3/1976 | Carin | 68/133 |
| 4,048,820 | A | 9/1977 | Pielemeier | 68/133 |
| 5,239,847 | A | 8/1993 | Lee | 68/134 |
| 6,212,722 | B1 | 4/2001 | Pinkowski et al. | 8/158 |

FOREIGN PATENT DOCUMENTS

| | | | |
|---|---|---|---|
| JP | 05-057088 | * | 3/1993 |

* cited by examiner

SPIRAL VANE CLOTHES MOVER

BACKGROUND OF THE INVENTION

1. Field of the Invention

The present invention relates to a system for washing clothes in an automatic washer and more particularly to an apparatus for causing clothes or cloth items to move within the wash chamber of an automatic washer.

2. Description of the Related Art

Automatic clothes washers are a common household appliance. They typically comprise a perforated basket for holding articles of clothing, sheets, towels, and other fabric items, and a tub containing a wash liquid comprising water or a mixture of water and detergent. The basket is enclosed in the tub so that the garments are immersed in the wash liquid. A motorized clothes mover is mounted in the bottom of the basket and adapted for angular oscillation in order to agitate the clothes. In one configuration, the basket, clothes mover, and tub are oriented about a generally vertical axis.

The vertical axis clothes mover can be configured where the clothes mover comprises an agitator, alone, or in combination with an elongated auger that extends along the vertical axis approximately the height of the tub, or an impeller, which is typically a low-profile circular plate with vanes. In a deep fill wash cycle, the clothes mover moves the garments along a toroidal, or donut-shaped, path extending radially inwardly toward the vertical axis, downwardly along the vertical axis, radially outwardly toward the outer wall of the basket, and upwardly to complete the path. One full cycle along this path is commonly referred to as a "rollover."

In a low water cycle, the clothes mover can be configured and oscillated to move the garments in what has been termed an "inverse toroidal rollover." This movement is described and illustrated in U.S. Pat. No. 6,212,722, which is fully incorporated herein. During inverse toroidal rollover, the garments follow the above-described path, but in an opposite direction.

In either configuration for the clothes movers, a relatively high motor torque is required to oscillate the clothes mover to effect the desired rollover. In either configuration, the garments do not move steadily along the agitator or impeller between the basket and the vertical axis, regardless of the direction of travel. Current clothes movers do not move the garments along the clothes movers at a generally uniform speed, resulting in the garments bunching in spots along the clothes mover. The bunching of the wetted clothes requires greater torque by the motor to oscillate the clothes mover. Thus, the motor must be sized to handle such a load. A reduction in the bunching of the garments along the clothes mover would permit the use of a smaller motor in combination with less power consumption, which reduces the manufacturing and operating costs of the clothes washer.

One advantage of using a low-profile clothes mover is that inverse toroidal rollover can be accomplished with relatively less water. However, a high torque motor must be utilized for a low water wash, particularly with clothes movers having less than optimal vane and apron configurations.

SUMMARY OF THE INVENTION

In a first embodiment, an automatic washer for washing garments comprises a wash basket with an open top defining a wash chamber, and a clothes mover mounted in the washer for reciprocal movement about an axis of rotation within the wash chamber. The clothes mover comprises an apron, and at least one vane extending from the apron and defining a working surface having an upper edge and a lower edge, the upper edge and the lower edge extending from an outer end to an inner end. At least one line lying along the working surface and extending between the outer end and the inner end defines a constant angle of attack relative to the direction of movement of the clothes mover.

In another embodiment, the working surface is configured to move the garments along the working surface at a substantially instantaneously uniform speed.

In another embodiment, the configurations of the upper surface and the working surface are optimized to move the garments between the perimeter and the axis of rotation while minimizing force acting on the working surface.

In yet another embodiment, the working surface defines a local draft angle that increases from the outer end to the inner end.

DESCRIPTION OF AN EMBODIMENT OF THE INVENTION

The invention described and illustrated herein comprises a vertical axis clothes mover for an automatic clothes washer having a vane configuration that imparts and optimizes a toroidal rollover motion, inverse or otherwise, to garments and other fabric items, such as sheets, towels, rugs and the like, contained therein (hereinafter referred to collectively as "garments"). During the oscillation of a clothes mover, the working surface of the vanes faces the flow of the garments. The angle between a line tangent to the working surface of the vane, and the flow line of the moving garments at the point of interaction of the garments and the direction of the clothes mover rotation, is termed the angle of attack. The angle of attack is crucial in defining the torque required to rotate the clothes mover. A clothes mover with a relatively small angle of attack requires less torque and energy to rotate than a clothes mover with a larger angle of attack.

With a prior art clothes mover, variation in the angle of attack along the working surface of a vane causes initiation of a non-uniform linear velocity of the garments at different points along the working surface of the vane. This contributes to non-uniform garment flow that can adversely affect rollover, a high level of energy losses in the drive system, and overworking of the motor. Additionally, during rollover garments in the wash basket follow the contour of the clothes mover, and this contour also becomes critical in minimizing the resistance of the clothes mover to the movement of the garments. The clothes mover apron of prior art clothes movers typically has a concave contour, and garments can collect on the surface of the apron. This causes a slow-down of rollover, and additional resistance acting on the clothes mover apron, which cause additional energy losses and motor overworking.

Figure 1:
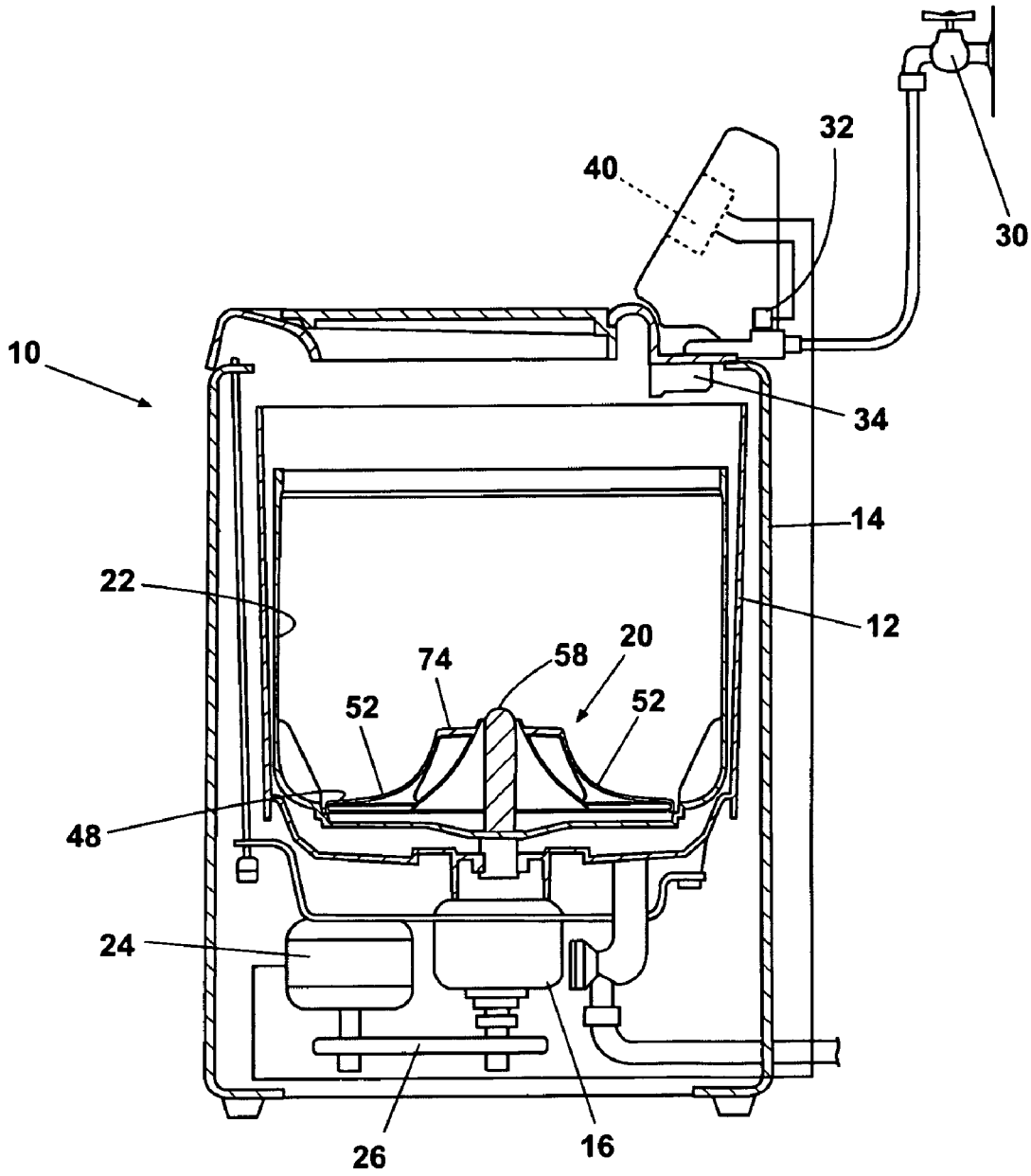
FIG. 1 is a partial cutaway view of an automatic clothes washing machine comprising a clothes mover according to the invention.

Referring to the Figures and to FIG. 1 in particular, an embodiment of the invention is illustrated comprising an automatic clothes washer 10 having a vertical axis clothes mover in the form of an impeller 20, according to the invention. The invention is illustrated and described herein with reference to a low-profile clothes mover, although other types of clothes movers, with and without augers, can be utilized. The automatic clothes washer 10 shares many elements of a well-known clothes washer, and such elements will not be described in detail herein except as necessary for a complete understanding of the invention. An example of an automatic clothes washer 10 having a vertical-axis clothes mover is more fully described in U.S. Pat. No. 6,212,722, which is incorporated herein by reference.

The automatic clothes washer 10 comprises a watertight tub 12 installed in a cabinet 14. A perforated wash basket 22 is mounted in the tub for rotation about a central, vertical axis. A drive motor 24 operating a transmission 16 through a drive belt 26 is utilized to rotate the wash basket 22 and oscillate the clothes mover 20. The clothes washer 10 is fluidly connected to a water supply 30 through a valve assembly 32 which can be operated to selectively deliver water to the tub 12 through an outlet 34. A control panel 40 enables the operator to control the operation of the clothes washer 10.

Figure 2:
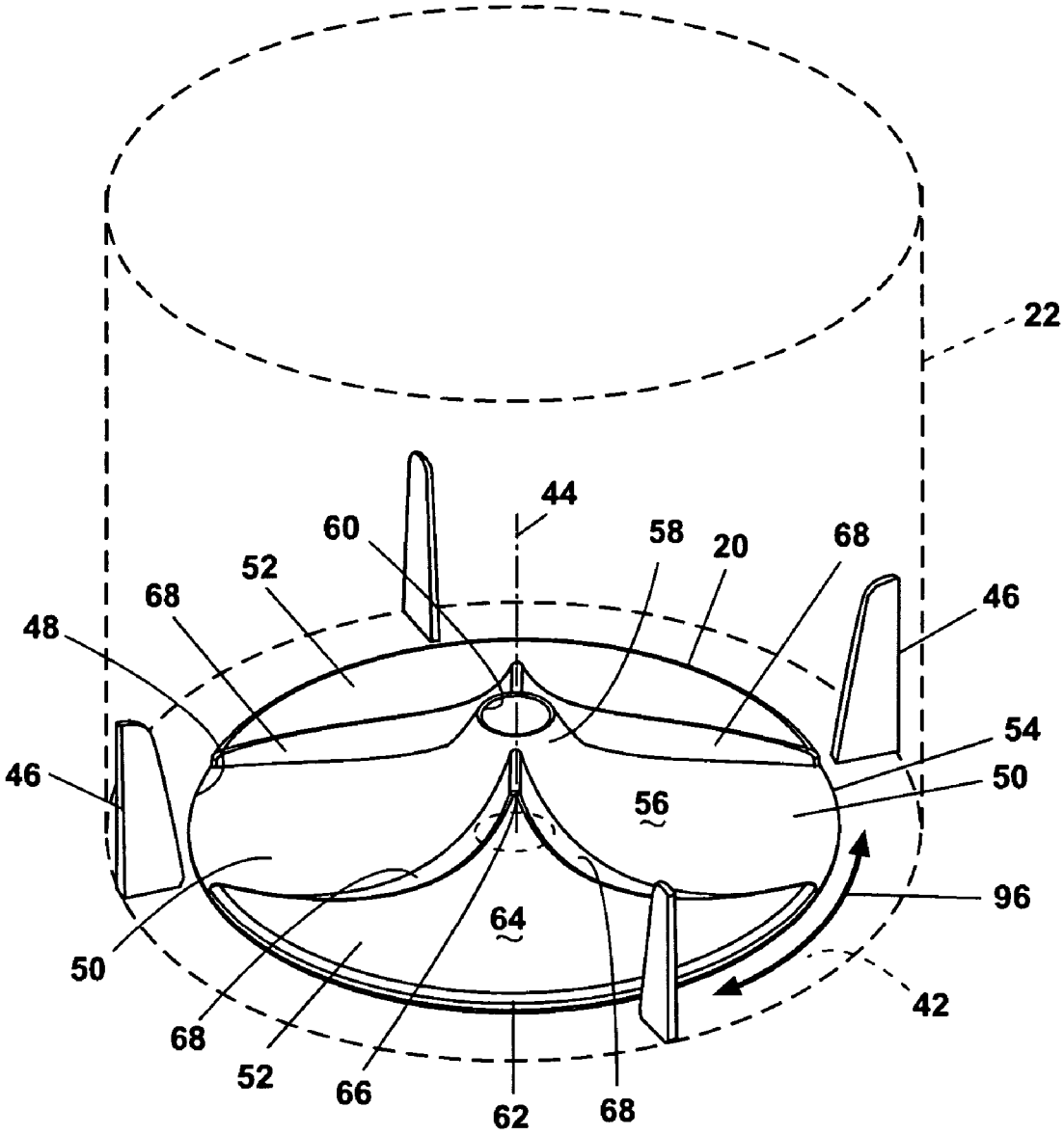
FIG. 2 is a perspective view of the clothes mover illustrated in FIG. 1 mounted within a wash basket for reciprocating movement in the wash basket about an axis of rotation, with the wash basket illustrated in phantom for clarity.

Referring also to FIG. 2, the bottom of the wash basket comprises an opening 48 adapted for cooperative registry with the clothes mover 20 surrounded by a stationary rim 42. The clothes mover 20 is adapted for oscillating motion relative to the stationary rim 42 about an axis of rotation 44 coaxial with the center of the wash basket 22. A plurality of stationary vanes 46 is illustrated extending upward from the rim 42 in regular spacing.

Figure 3:
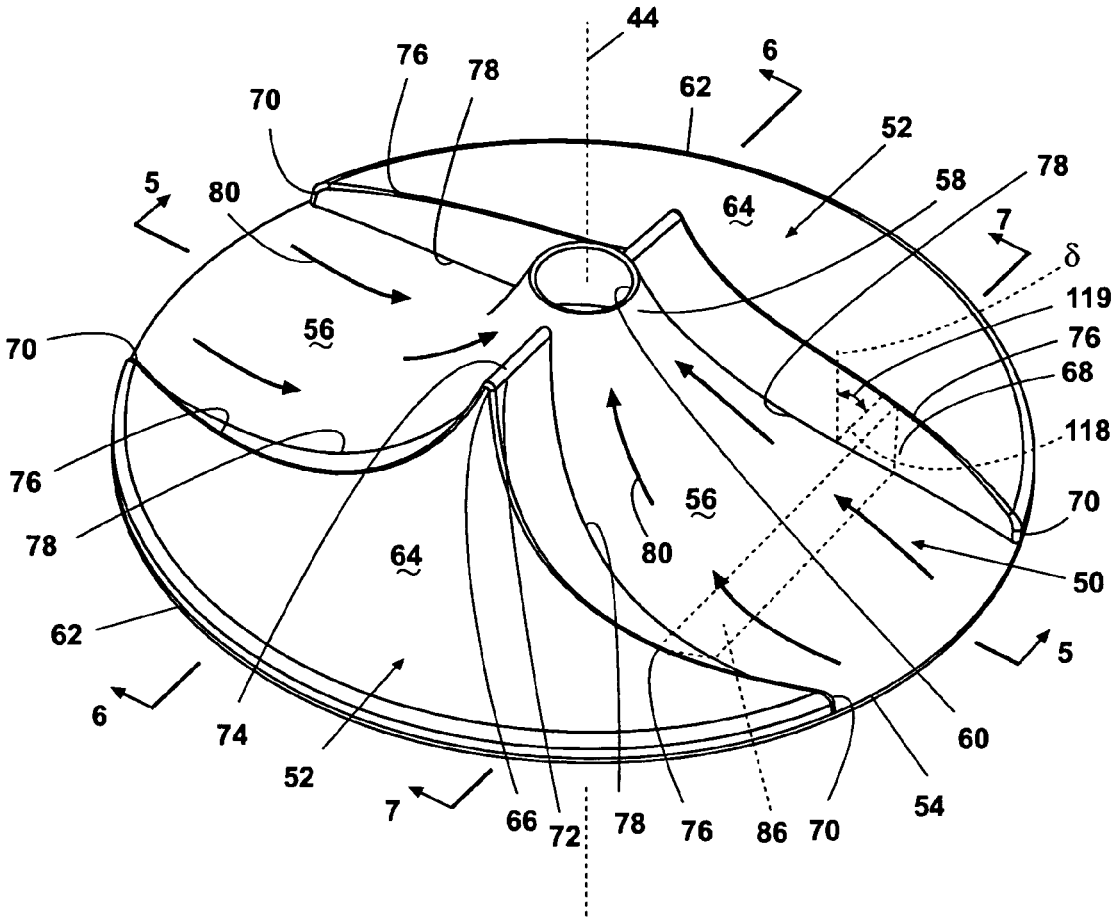
FIG. 3 is a perspective view of the clothes mover illustrated in FIG. 2 illustrating a parabolic apron and a pair of vanes having working faces defined by logarithmic spirals.
Figure 4:
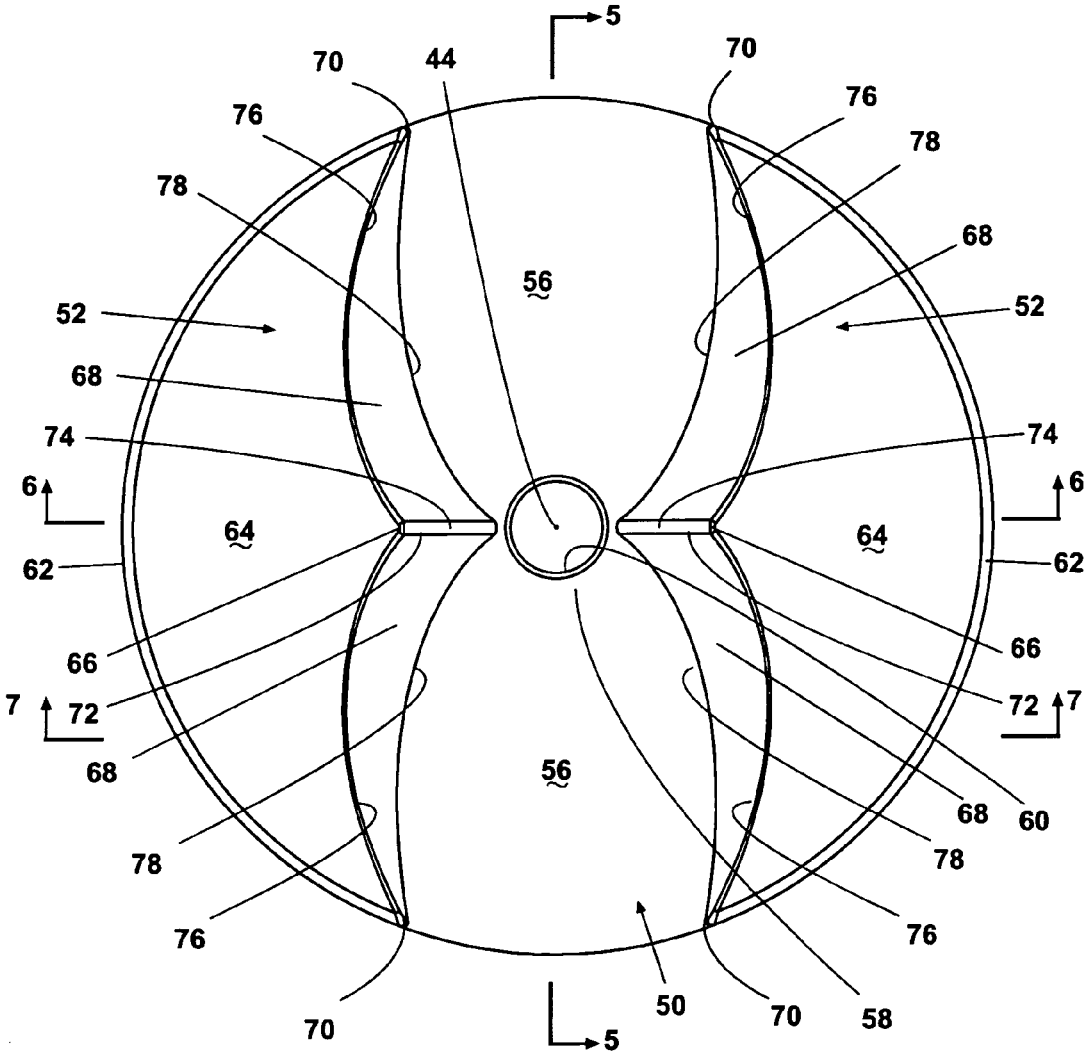
FIG. 4 is a plan view of the clothes mover illustrated in FIG. 3.

Referring now to FIGS. 3 and 4, the clothes mover 20 is illustrated as a generally circular, somewhat conical body comprising a clothes mover apron 50 and a pair of diametrically-opposed clothes mover vanes 52. Although the clothes mover apron 50 is interrupted by the vanes 52, the clothes mover apron 50 can be visualized as a somewhat truncated cone-shaped body having a circular apron peripheral edge 54 transitioning inwardly and upwardly through an apron surface 56 to a center extension 58. The center extension 58 terminates in a circular center opening 60 coaxial with the axis of rotation 44. The clothes mover 20 is illustrated as comprising a pair of diametrically-opposed vanes 52, although three or four uniformly-shaped, regularly-spaced vanes can be utilized.

Figure 5:
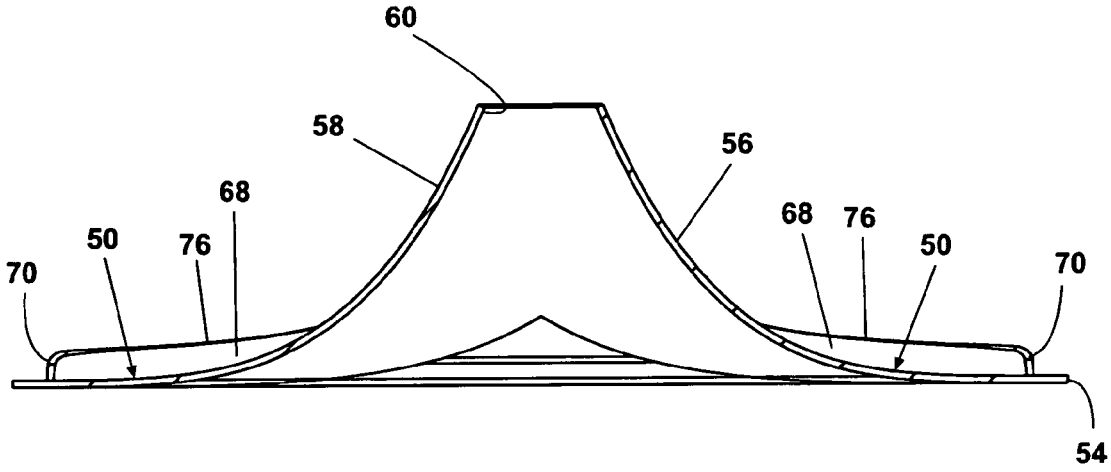
FIG. 5 is a sectional view of the clothes mover illustrated in FIG. 3 taken along view line 5-5.

As also illustrated in FIG. 5, the apron surface 56 is upwardly concavely curved. The curvature of the surface 56 is illustrated as a parabolic curve, preferably a second order to an eighth order parabolic curve, more preferably a fourth order parabolic curve, although the curvature of the surface 56 can be circular, geometric, or linear. The contour of the apron surface 56 is selected to provide a gradual change in the direction of the inverse toroidal garment movement from the periphery toward the center of the clothes mover 20 and upward along the center extension 58.

Figure 6:
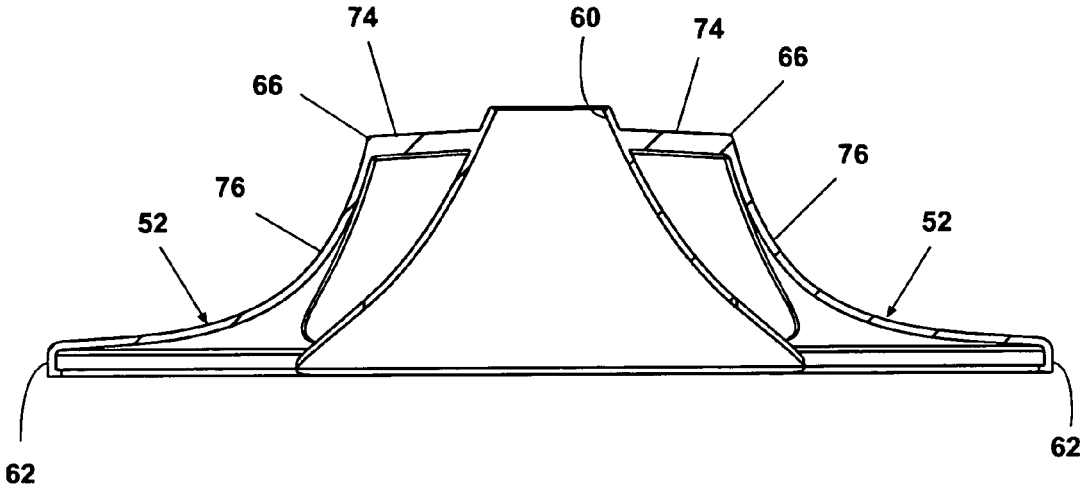
FIG. 6 is a sectional view of the clothes mover illustrated in FIG. 3 taken along view line 6-6.
Figure 7:
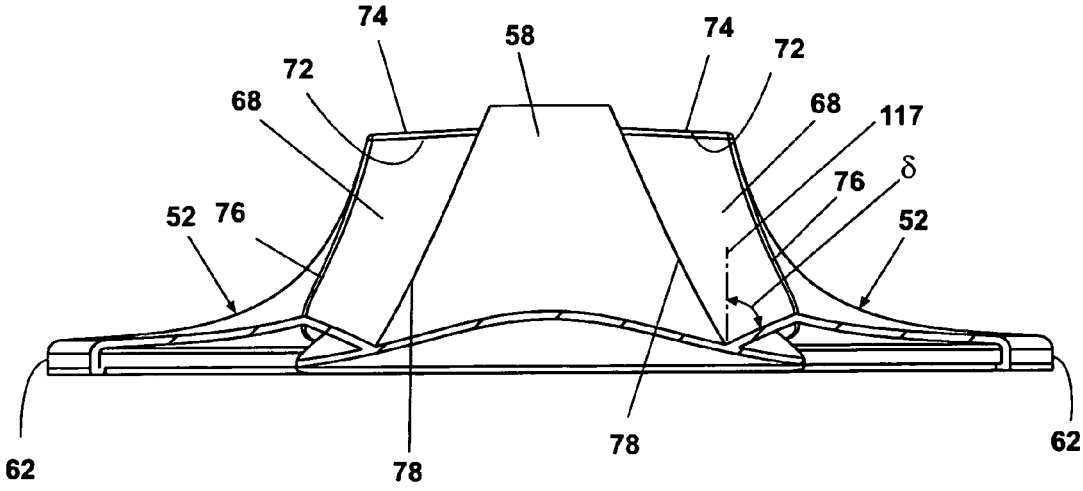
FIG. 7 is a sectional view of the clothes mover illustrated in FIG. 3 taken along view line 7-7.

Referring again to FIGS. 3 and 4, the clothes mover vanes 52 are diametrically-opposed, somewhat fan-shaped projections extending above the surface 56 of the clothes mover apron 50. Each vane 52 has a semicircular vane peripheral edge 62 transitioning inwardly and upwardly through a curved vane surface 64 to a vane apex 66. As illustrated also in FIGS. 6 and 7, the apex 66 is connected to the center extension 58 through a radially-oriented, approximately horizontal ridge 74. The vane surface 64 transitions toward the apron surface 56 through a working face 68. The working face 68 has both curvature and a varying draft.

The working face 68 extends from an outer end 70, at the intersection of the working face 68 with the vane peripheral edge 62, to an inner end 72 coextensive with the ridge 74. The working face 68 is bounded along the vane surface 64 by an upper edge 76 extending from the outer end 70 to the inner end 72, and along the apron surface 56 by a lower edge 78 extending from the outer end 70 to the inner end 72. The working face 68 "rolls over" from the outer end 70 to the inner end 72.

Figure 8:
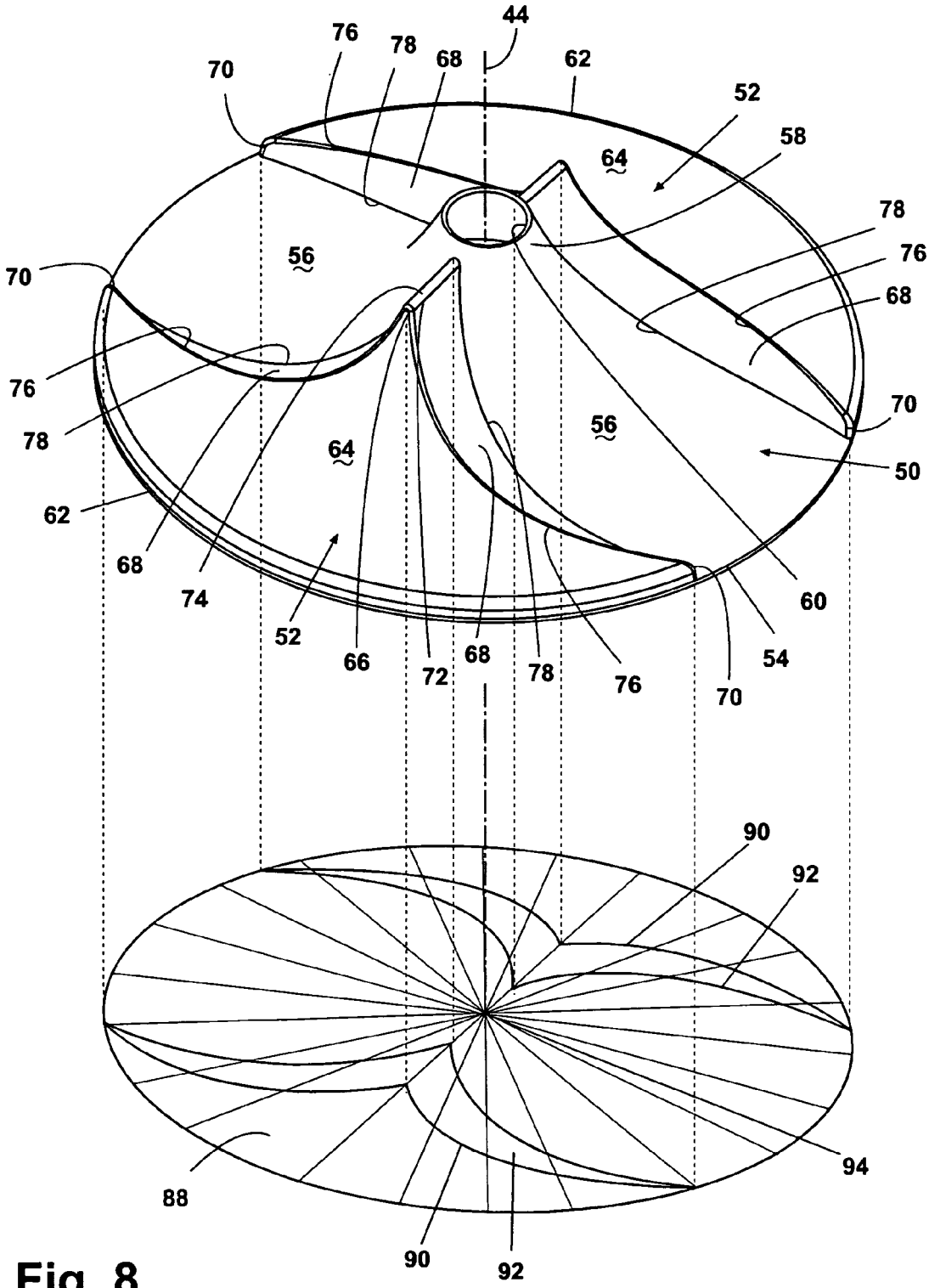
FIG. 8 is a perspective view of the clothes mover illustrated in FIG. 3 and a projection thereof onto a plane orthogonal to the axis of rotation.
Figure 9:
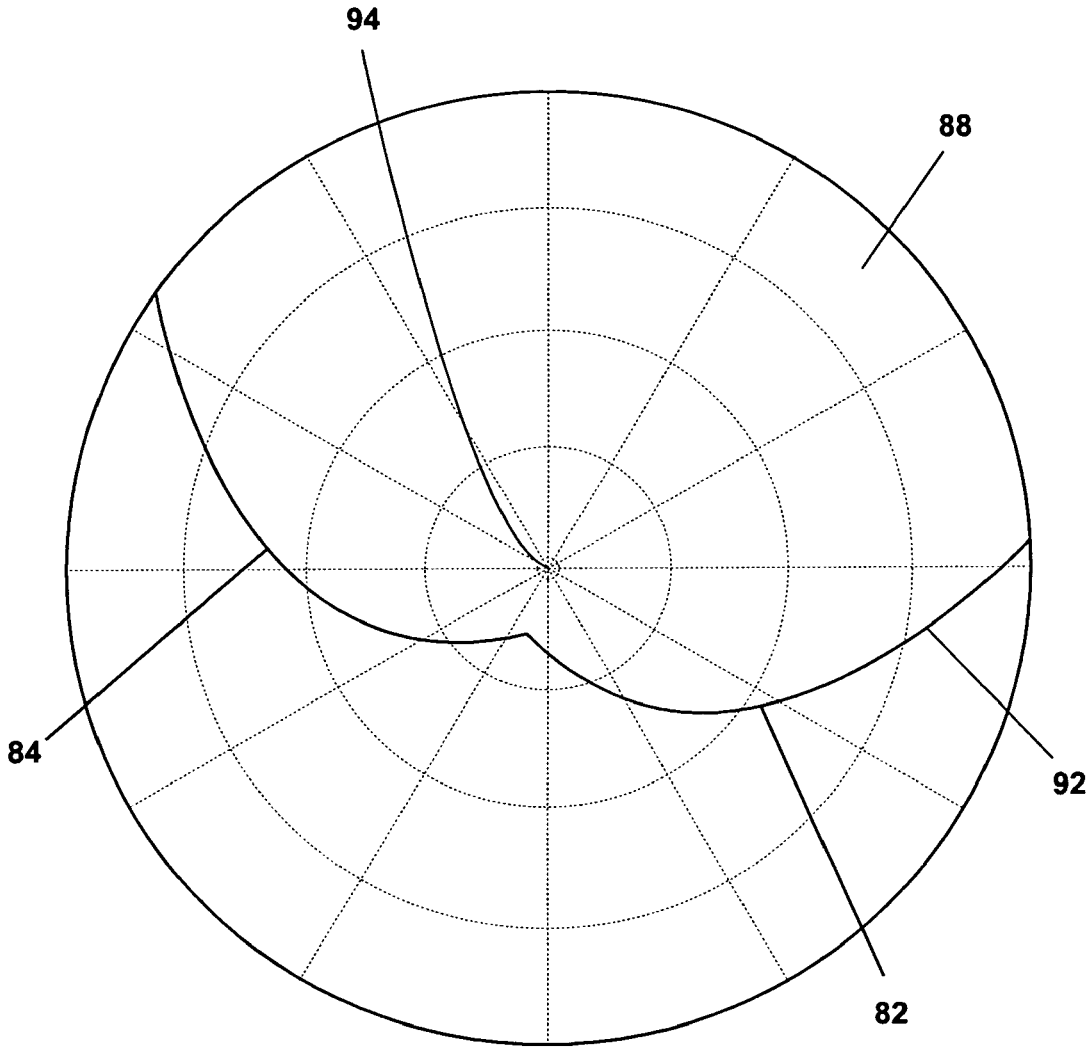
FIG. 9 is a plan view of the plane illustrated in FIG. 6 containing a logarithmic spiral curve representing the projection of an edge of a vane.

FIG. 8 also illustrates a projection of the clothes mover vanes 52 onto a plane 88 orthogonal to the axis of rotation 44. As described above, the upper edge 76 and the lower edge 78 of each vane 52 comprise curve segments occupying 3-dimensions. Projection of the upper edge 76 onto the plane 88 produces a 2-dimensional projected upper edge 90, and projection of the lower edge 78 onto the plane 88 produces a 2-dimensional projected lower edge 92. The projected upper edge 90 and the projected lower edge 92 are illustrated herein as segments of a logarithmic spiral, although the projected edges 90, 92 can be segments of Archimedean spirals or other spirals suitable for the purposes described herein. FIG. 9 illustrates in plan view the projected lower edge 92 on the plane 88. The projected lower edge 92 comprises a joined pair of logarithmic spiral segments 82, 84.

A logarithmic spiral has the general equation $r=ae^{b\theta}$, where r is the distance from the origin to the spiral for a selected value of θ, a is a constant controlling the size of the spiral, b is a constant controlling how fast the spiral uncoils or the "tightness" of the spiral, and θ is in radians. The advantage of using a working surface defined by a logarithmic spiral is that an angle of attack relative to the logarithmic spiral remains constant along the spiral. However, any spiral or combination of spirals, such as an Archimedean spiral or other suitable spiral, providing an optimal angle of attack, can be used to define the upper and lower edges 76, 78, respectively. For example, the upper edge 76 can be an Archimedean spiral and the lower edge 78 can be a logarithmic spiral, with the working face 68 transitioning smoothly from the Archimedean spiral to the logarithmic spiral.

Figure 10:
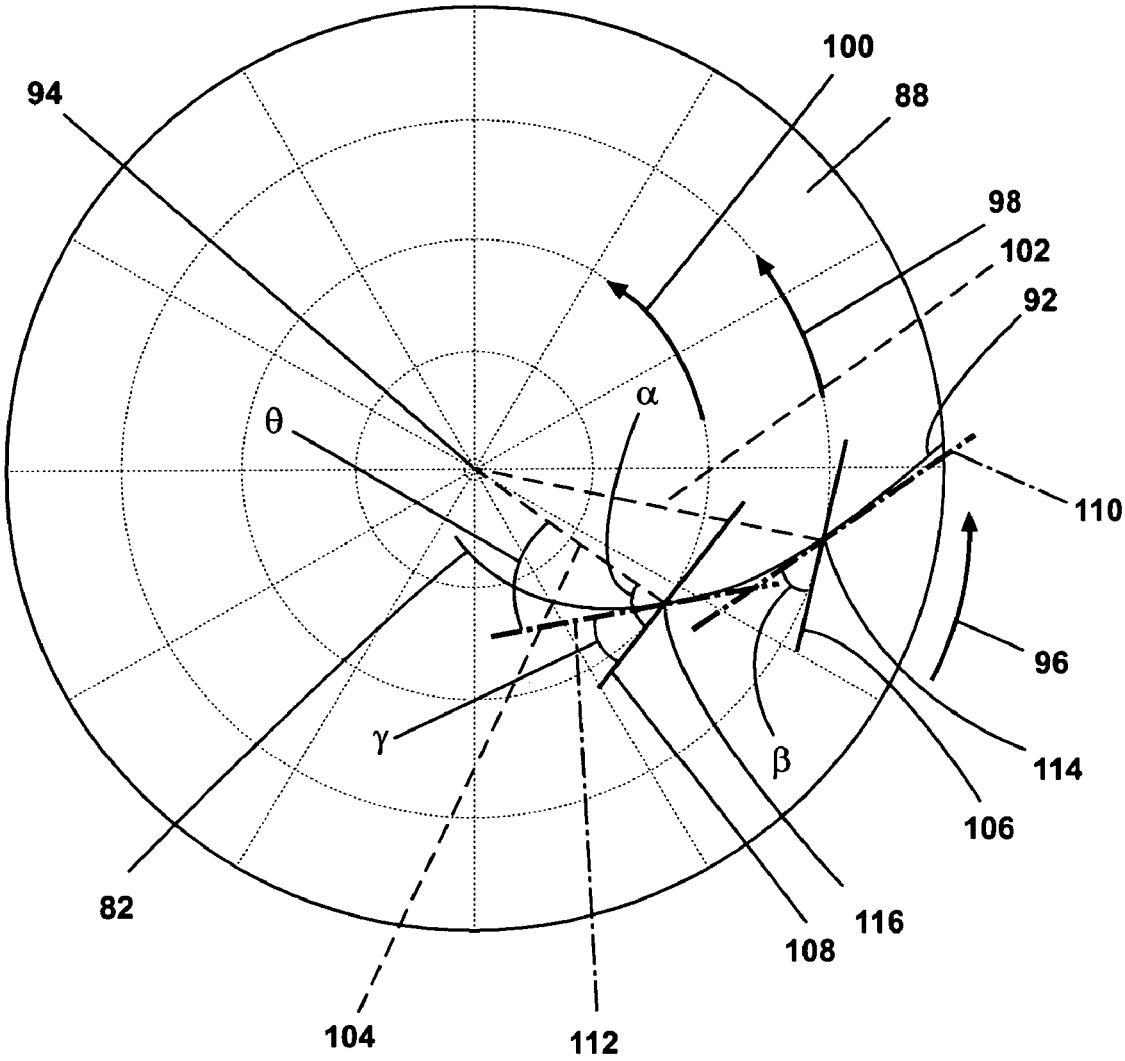
FIG. 10 is a plan view of the plane illustrated in FIG. 9 containing a segment of the logarithmic spiral curve and illustrating a constant angle of attack.

The angle of attack can be understood by reference to FIGS. 9 and 10. FIG. 9 illustrates the logarithmic spiral segments 82, 84 in the configuration of the projected upper edge 90. The first segment 82 comprises a segment of a first logarithmic spiral, and the second segment 84 comprises a mirror image of the first segment 82, joined at the projection of the apex 66. The first segment 82 is also illustrated in FIG. 10, and is defined relative to an origin 94 corresponding to the axis of rotation 44.

The segment 82 is assumed to rotate in a counterclockwise direction, as indicated by a rotation vector 96. The rotation of the segment 82 at a first radius 102 is represented by a rotation vector 98; the rotation of the segment 82 at a second radius 104 is represented by a rotation vector 100. Each radius 102, 104 defines a circle concentric with the origin 94 and rotating with the same angular velocity. Thus, a circle defined by the first radius 102 will rotate as indicated by the rotation vector 98, and a circle defined by the second radius 104 will rotate as indicated by the rotation vector 100.

Each circle will intersect the logarithmic spiral segment 82 at a point 114, 116. Each point 114, 116 defines a point of tangency of a tangent line 110, 112 for the logarithmic spiral segment 82. Each point 114, 116 also comprises the intersection of a circle with the logarithmic spiral segment 82, and defines a point of tangency of a tangent line 106, 108 for the circle. The angle $\gamma$ between the tangent lines 108, 112 is constant and equal to the angle $\beta$ between the tangent lines 106, 110. This angle is referred to as the angle of attack, and is constant along the entire length of the logarithmic spiral 82. The magnitude of the angle of attack is dependent upon the "tightness" of the logarithmic spiral. A preferred angle of attack ranges between 15° and 85°. The "tightness" of the logarithmic spiral is selected to provide an angle of attack within this range. The constant angle of attack provides an inverse toroidal rollover velocity of garments that has minimal variability.

Referring again to FIGS. 3 and 7, the working face 68 is illustrated as inclined. The angle of inclination along the working face 68 can be defined by a surface line 118 extending from the lower edge 78 to the upper edge 76, and a reference line 117 intersecting the surface line 118 at the lower edge 78 parallel to the axis of rotation 44. The angle of inclination 6 defined by the lines 117, 118 is a measure of the inclination of the working surface at that location and is referred to herein as the "draft" of the working face 68. Referring again to FIG. 3, the draft $\delta$ can vary from 0° at the outer end 70 of the vane 52 to 90° or more at the inner end 72 of the vane 52. The draft $\delta$ along the working face 68 is selected to optimize the movement of the garments toward the axis of rotation 44 and minimize the torque on the drive motor 24.

During a washing cycle, the clothes mover 20 translates angularly in alternating directions about the axis of rotation 44. Thus, the clothes mover 20 repeatedly oscillates through a movement cycle starting with the clothes mover 20 at rest, accelerating in a clockwise direction to a maximum velocity, then decelerating in a clockwise direction to an at rest position, then accelerating in a counterclockwise direction to a maximum velocity, and decelerating in a counterclockwise direction to an at rest position. The cycle is then repeated. The angular acceleration and angular velocity of the clothes mover 20 vary during the movement cycle. Thus, the angular acceleration and angular velocity of the working face 68 also varies during the movement cycle. Consequently, the velocity of a mass body along the working face 68 toward the axis of rotation 44 varies during the movement cycle. However, at any point in time during the movement cycle, the velocity of the mass body along the working face 68 toward the axis of rotation 44 is the same at every point along the working face 68. Thus, the velocity of the mass body will vary with time during the movement cycle, but at any point in time the velocity of the mass body will be the same at every point along the working face 68. This velocity at every point along the working face 68 at any point in time during the movement cycle is referred to as an "instantaneously uniform" velocity or rate.

The height of the working face 68 between the upper edge 76 and the lower edge 78 is selected to optimize flow along the apron surface 56 between opposed working faces 68. Preferably, the height and draft of the working faces 68 are selected so that the flow rate between the opposed working faces 68 is instantaneously uniform. Referring again to FIG. 3, the height and draft of the working faces 68 are selected based upon the profile of the apron surface 56 to define an area 86 orthogonal to the flow 80 bounded by the working faces 68, the apron surface 56, and a line extending between the upper edges 76. All similarly-defined areas from the outer end 70 to the inner end 72 will have an instantaneously uniform flow rate therethrough to facilitate the movement of garments along the apron surface 56 from the periphery of the clothes mover 20 toward and upward along the center extension 58. Inverse toroidal rollover motion during oscillation of the clothes mover 20 is as described in U.S. Pat. No. 6,212,722. However, more energy is imparted by the clothes mover 20 to the garments, and fewer energy losses are experienced in the automatic clothes washer 10 having the herein-described clothes mover 20. Movement of garments along the apron surface 56 and upward along the center extension 58 is more uniform and fluid, and imposes less torque on the motor 24.

Figure 11:
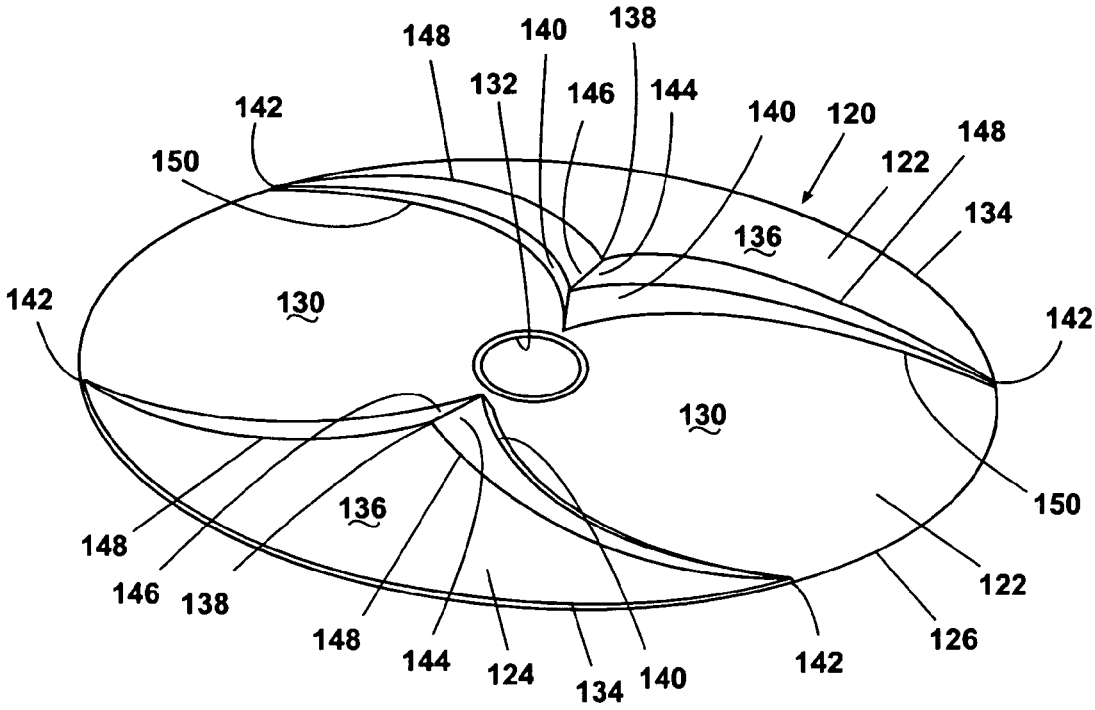
FIG. 11 is a perspective view of a second embodiment of a clothes mover according to the invention.

FIG. 11 illustrates a second embodiment of an oscillating clothes mover 120 which is similar in many respects to the clothes mover 20, except that the apron surface 130 is essentially flat, and does not extend parabolically upward to a center extension 58. The clothes mover 120 is provided with a generally flat clothes mover apron 122 and a pair of fan-like opposed clothes mover vanes 124 extending upwardly from the clothes mover apron 122. The clothes mover apron 122 extends from a peripheral edge 126 to a center opening 132 and defines a generally flat apron surface 130.

The vanes slope upwardly from a peripheral edge 134 to an apex 138 and define a vane surface 136 having a generally curved, preferably parabolic, contour. A working face 140 is defined by an outer end 142 at the peripheral edge 134 which transitions to an inner end 144 terminating at a ridge 146, an upper edge 148, and a lower edge 150. One or both edges 148, 150 are logarithmic. The working face 140 is similar in most respects to the working face 68, and "rolls over" as it transitions from the outer end 142 to the inner end 144. The working face 140 can be inclined to define a draft similar to the working face 68.

Figure 12:
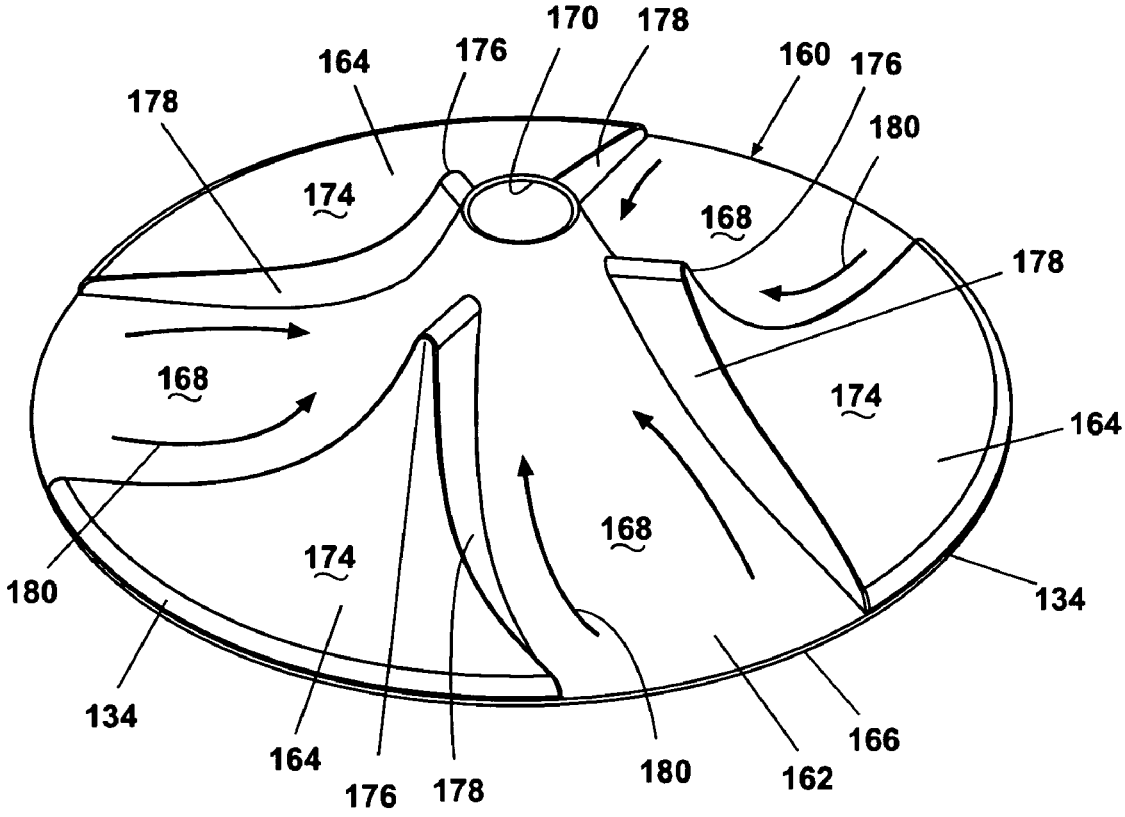
FIG. 12 is a perspective view of a third embodiment of a clothes mover according to the invention.

FIG. 12 illustrates a third embodiment of a clothes mover 160 having a trio of regularly-spaced, fan-shaped vanes 164 extending upwardly from a curved clothes mover apron 162. The clothes mover 160 is similar in many respects to the clothes mover 20. The clothes mover apron 162 extends from an apron peripheral edge 166 along a preferably parabolic apron surface 168 to a center opening 170. The vanes 164 extend from a peripheral edge 172 along a curved, preferably parabolic vane surface 174 to an apex 176. The vanes 164 define working faces 178 similar in configuration and orientation to the working faces 68. Oscillation of the clothes mover 160 urges inverse toroidal rollover motion of the garments along the clothing movement vectors 180.

Figure 13:
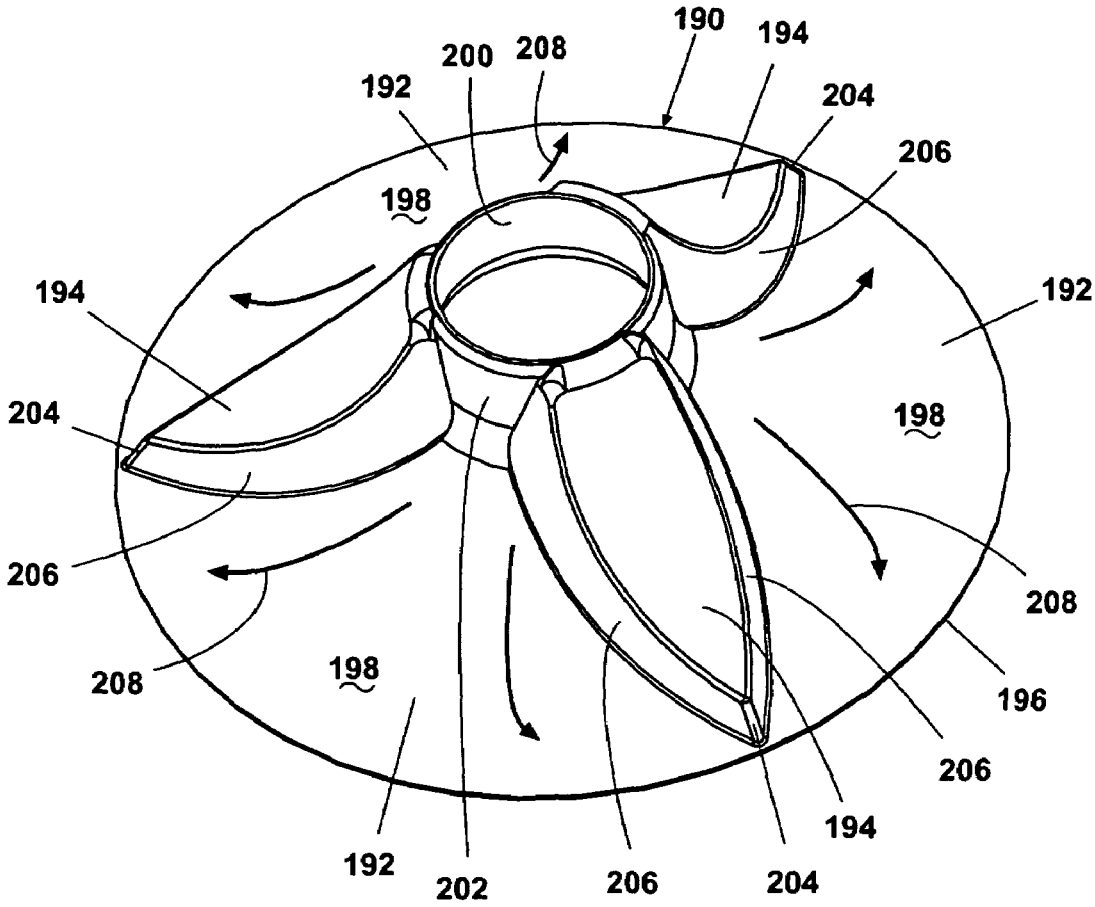
FIG. 13 is a perspective view of a fourth embodiment of a clothes mover according to the invention.

FIG. 13 illustrates a fourth embodiment of a clothes mover 190 comprising a plurality of clothes mover vanes 194 extending upwardly from a clothes mover apron 192, which urge garments into outward toroidal rollover motion. The clothes mover 190 is illustrated as a generally circular body comprising a somewhat truncated cone-shaped clothes mover apron 192 having a circular apron peripheral edge 196 transitioning inwardly and upwardly through an apron surface 198 to a center collar 202. The center collar 202 terminates in a circular center opening 200 coaxial with the axis of rotation 44 of the clothes mover 190. The clothes mover apron 192 can have a surface contour that is conical or concavely curved. The curvature of the surface 198 can comprise a parabolic curve, preferably a second order to an eighth order parabolic curve, more preferably a fourth order parabolic curve, although the curvature of the surface 198 can be circular or geometric. The contour of the apron surface 198 is selected to provide a gradual change in the direction of the toroidal garments movement from the center collar 202 toward the peripheral edge 196

The clothes mover vanes 194 are somewhat wedge-shaped bodies having opposed working faces 206 extending from the center collar 202 toward the peripheral edge 196 to terminate in an apex 204 adjacent the peripheral edge 196. The working faces 206 are convexly curved, preferably logarithmically, and inclined to define a draft. The orientation of the clothes mover vanes 194 with the apex 204 adjacent the peripheral edge 196, and the convex curvature of the working faces 206, impart a toroidal motion to the garments along the outwardly directed movement vectors 208

Figure 14:
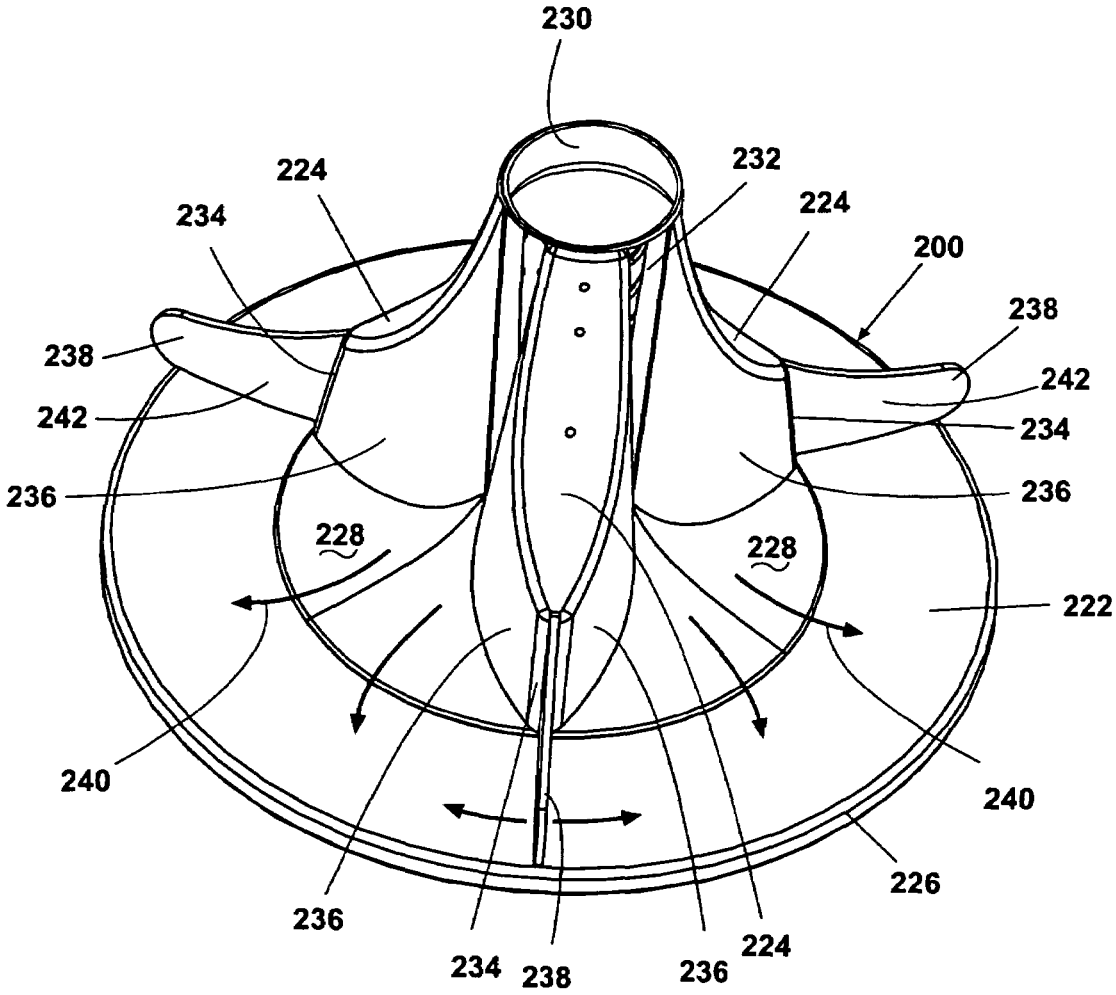
FIG. 14 is a perspective view of the fifth embodiment of a clothes mover according to the invention.

FIG. 14 illustrates a fifth embodiment of a clothes mover 220 comprising a clothes mover apron 222 and a plurality of regularly-spaced clothes mover vanes 224 extending upwardly therefrom. The clothes mover apron 222 extends from a circular peripheral edge 226 through an apron surface 228 to a center collar 232 having a center opening 230 therethrough. The apron surface 228 can be flat, inclined, curved, or a combination thereof. The clothes mover vanes 224 are similar in configuration to the clothes mover vanes 194 illustrated in FIG. 13, and comprise a pair of opposed, convex working faces 236 extending radially away from the collar 232 to join at an apex 234. A flexible paddle 238 is attached to the apex 234 of each vane 224 and comprises a pair of opposed paddle faces 242. The paddles 238 are adapted for flexure during oscillation of the clothes mover 220 so that the curvature of the working faces 236 extends continuously to the paddle face 242 to increase the effective length of the working faces 236. The flexibility of the paddles 238 reduces energy losses during movement of the vanes 224 through the wash liquid and into contact with the garments, while providing a curved working surface having a length that is effectively greater than the working faces 236, thereby facilitating the toroidal movement of the garments along the motion vectors 240.

Figure 15:
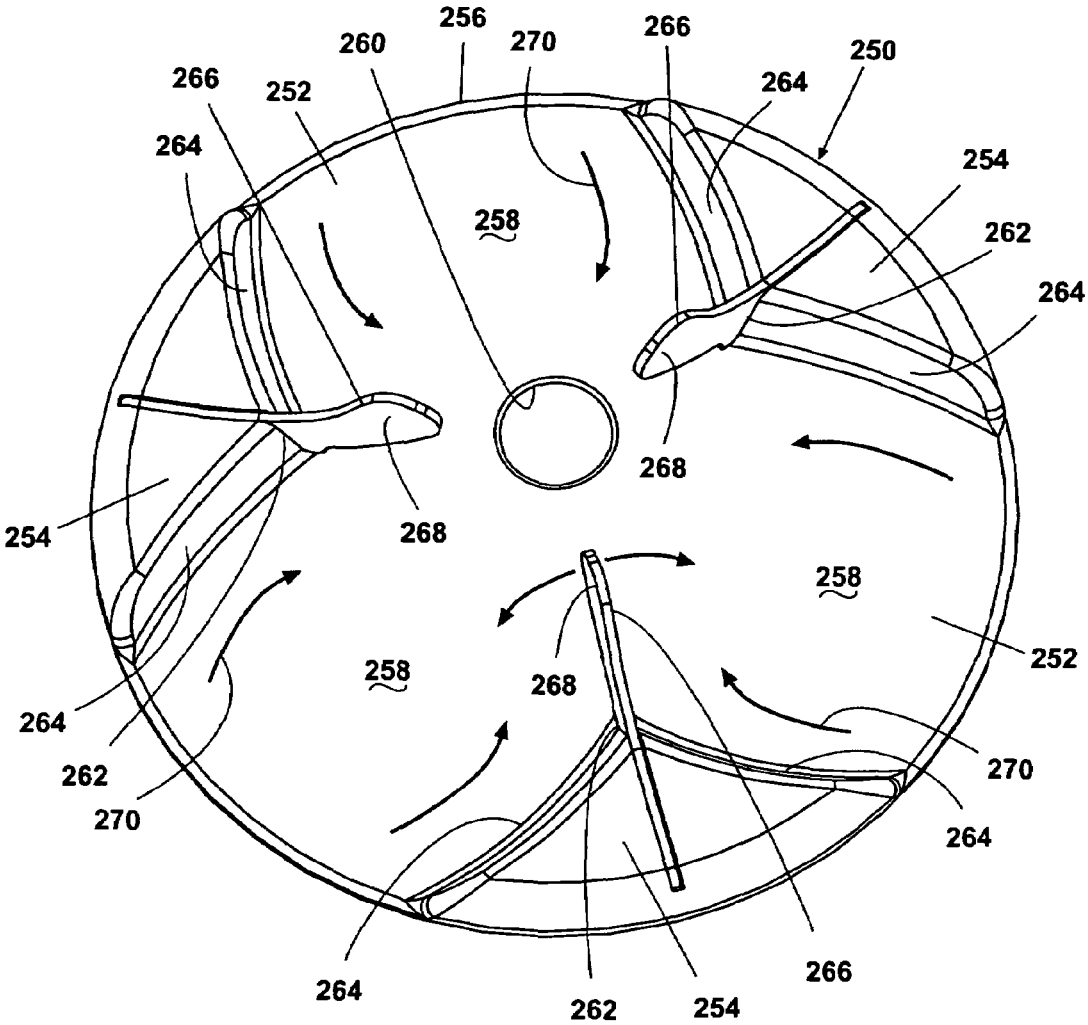
FIG. 15 is a perspective view of a sixth embodiment of a clothes mover according to the invention.

FIG. 15 illustrates a sixth embodiment of a clothes mover 250 comprising a clothes mover apron 252 having a plurality of clothes mover vanes 254 regularly spaced therearound. The apron 252 extends from a circular peripheral edge 256 through an apron surface 258 to a center opening 260 extending through the clothes mover 250. The apron surface can be flat, inclined, curved, or a combination thereof. The vanes 254 are generally fan-shaped bodies extending upwardly from the apron surface 258, and radially inwardly from the peripheral edge 256 to an apex 262. A curved working face 264 extends from the peripheral edge 256 to the apex 262. Preferably, the curvature of the working face 264 is logarithmic, although other curvatures can be utilized, such as Archimedean, linear, or a combination thereof.

A flexible paddle 266 extends radially inwardly toward the center opening 260 from the apex 262, and comprises a pair of opposed paddle faces 268. Similar to the paddles 238 illustrated in FIG. 14, the paddles 266 are adapted for flexure during oscillation of the clothes mover 250 so that the curvature of the working faces 264 extends continuously to the paddle faces 268 to increase the effective length of the working faces 264. The flexibility of the paddles 266 reduces energy losses while providing a curved working surface having a length that is effectively greater than the working faces 264, thereby facilitating the inverse toroidal movement of the garments along the motion vectors 270.

The clothes mover vanes described herein having working surfaces defined by logarithmic spirals provide a clothes moving device which facilitates efficient movement, and rollover, of the garments being cleaned. Because the angle of attack of such spirals remains constant along the length of the spiral segments defining the working faces of the vanes, movement of the garments along the vanes is at an instantaneously uniform velocity. The use of a parabolic clothes mover apron intermediate the vanes facilitates the efficient movement of the garments in a toroidal rollover pattern. The enhanced efficiency of the movement of the garments along the vanes and the clothes mover apron reduces the torque on the drive motor, thereby increasing the life of the motor, and reducing the energy requirements of the motor. The enhanced movement of the garments also reduces wear of the garments caused by impacts from the vanes, and enables the clothing to the cleaned in a smaller volume of wash liquid.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An automatic washer for washing garments, comprising:

a wash basket with an open top defining a wash chamber; and a clothes mover mounted in the washer for reciprocal movement about an axis of rotation within the wash chamber, the clothes mover comprising:

an apron; and at least one vane extending from the apron and defining a working surface having an upper edge and a lower edge, the upper edge and the lower edge extending from an outer end to an inner end;

wherein the working surface is shaped such that at least one line lying along the working surface and extending between the outer end and the inner end defines a constant angle of attack relative to the direction of movement of the clothes mover.

2. An automatic washer according to claim 1 wherein the working surface is one of convex and concave.

3. An automatic washer according to claim 1 wherein the at least one line defines the same constant angle of attack.

4. An automatic washer according to claim 1 wherein the at least one line defining the constant angle of attack is one of the upper edge and the lower edge.

5. An automatic washer according to claim 1 wherein a projection of the one of the upper edge and the lower edge onto a plane perpendicular to the axis of rotation defines a constant angle of attack.

6. An automatic washer according to claim 5 wherein a projection of both of the upper and lower edges onto a plane perpendicular to the axis of rotation defines a constant angle of attach in the plane.

7. An automatic washer according to claim 1 wherein a projection of the at least one line onto a plane perpendicular to the axis of rotation defines a constant angle of attack.

8. An automatic washer according to claim 1 wherein the at least one line is a logarithmic spiral.

9. An automatic washer according to claim 1 wherein the working surface twists from the outer end to the inner end.

10. An automatic washer according to claim 9 wherein a first line extending along the working surface from a first point on the lower edge to a second point on the upper edge and a second line extending vertically through the first point define a local draft angle, and a local draft angle at the outer end is oriented more vertically than a local draft angle at the inner end.

11. An automatic washer according to claim 10 wherein the working surface at the inner end is substantially horizontal.

12. An automatic washer according to claim 10 wherein the working surface at the outer end is substantially vertical.

13. An automatic washer according to claim 1 wherein the at least one vane comprises one of two, three, or four vanes.

14. An automatic washer according to claim 13 wherein one of the two, three, or four vanes comprises a first working face in opposed, complementary relationship to a second working face of an adjacent one of another of the two, three, or four vanes.

15. An automatic washer according to claim 14 wherein the first and second working faces have a draft and height selected so that flow between the first and second working faces is constant.

16. An automatic washer according to claim 1 wherein the apron is a flat plate.

17. An automatic washer according to claim 1 wherein the apron has a curved cross section.

18. An automatic washer according to claim 17 wherein the curved cross section is in the form of a parabola.

19. An automatic washer according to claim 18 wherein the parabola is one of a $2^{nd}$ order to an $8^{th}$ order parabola.

20. An automatic washer according to claim 19 wherein the parabola is a $4^{th}$ order parabola.

21. An automatic washer according to claim 1 wherein the angle of attack varies from 15° to 85°.

22. An automatic washer according to claim 1 wherein a line extending along the working surface from the lower edge to the upper edge is straight.

23. An automatic washer according to claim 1 wherein a line extending along the working surface from the lower edge to the upper edge is concave.

24. An automatic washer according to claim 1 wherein a line extending along the working surface from the lower edge to the upper edge is convex.

25. An automatic washer for washing garments, comprising:

a wash basket with an open top defining a wash chamber and having a substantially vertical axis of rotation; and a clothes mover mounted in the washer for reciprocal movement about the substantially vertical axis of rotation within the wash chamber, the clothes mover comprising:

an apron;

at least one vane extending from the apron and defining a working surface having an upper edge and a lower edge, the upper edge and the lower edge extending from an outer end to an inner end;

wherein the working surface is shaped such that at least one line lying along the working surface and extending between the outer end and the inner end defines a constant angle of attack relative to the direction of movement of the clothes mover move the garments along the working surface at a substantially instantaneously uniform speed.

26. An automatic washer according to claim 25 wherein the working surface is one of convex and concave.

27. An automatic washer according to claim 25 wherein a projection of the one of the upper edge and the lower edge onto a plane perpendicular to the axis of rotation defines a logarithmic spiral.

28. An automatic washer according to claim 27 wherein a projection of both of the upper and lower edges onto a plane perpendicular to the axis of rotation defines a logarithmic curve in the plane.

29. An automatic washer according to claim 25 wherein the working surface twists from the outer end to the inner end.

30. An automatic washer according to claim 25 wherein a first line extending along the working surface from a first point on the lower edge to a second point on the upper edge and a second line extending vertically through the first point define a draft angle, and a draft angle at the outer end is oriented more vertically than a draft angle at the inner end.

31. An automatic washer according to claim 30 wherein the working surface at the inner end is substantially horizontal.

32. An automatic washer according to claim 30 wherein the working surface at the outer end is substantially vertical.

33. An automatic washer according to claim 25 wherein the apron is a flat plate.

34. An automatic washer according to claim 25 wherein the apron has a curved cross section.

35. An automatic washer according to claim 34 wherein the curved cross section is in the form of a parabola.

36. An automatic washer according to claim 35 wherein the parabola is one of a 2nd order to an $8^{th}$ order parabola.

37. An automatic washer according to claim 36 wherein the parabola is a $4^{th}$ order parabola.

38. An automatic washer according to claim 25 wherein a line extending along the working surface from the lower edge to the upper edge is straight.

39. An automatic washer according to claim 25 wherein a line extending along the working surface from the lower edge to the upper edge is concave.

40. An automatic washer according to claim 25 wherein a line extending along the working surface from the lower edge to the upper edge is convex.

41. An automatic washer according to claim 25 wherein the at least one vane comprises two adjacent vanes and one of the two adjacent vanes comprises a first working face in opposed, complementary relationship to a second working face of the other of the two adjacent vanes.

42. An automatic washer according to claim 41 wherein the first and second working faces have a draft and height selected so that flow between the first and second working faces is constant.

43. An automatic washer for washing garments, comprising:

a wash basket with an open top defining a wash chamber;

a clothes mover provided within the wash chamber, the clothes mover comprising:

an apron having a perimeter mounted for rotation about an axis of rotation and having an upper surface with a parabolic cross section in a plane containing the axis of rotation;

at least one vane extending from the apron and defining a working surface having an upper edge and a lower edge, the upper edge and the lower edge extending from an outer end to an inner end;

wherein the upper surface and the working surface are shaped to move the garments between the perimeter and the axis of rotation to reduce the force acting on the working surface.

44. An automatic washer according to claim 43 wherein the garments move between the perimeter and the axis of rotation at an instantaneously uniform speed.

45. An automatic washer according to claim 44 wherein a first line extending along the working surface from a first point on the lower edge to a second point on the upper edge and a second line extending vertically through the first point define a draft angle, and the draft angle is selected to minimize the force acting on the working surface.

46. An automatic washer according to claim 45 wherein at least one line lying along the working surface and extending between the outer end and the inner end defines a constant angle of attack relative to the direction of movement of the clothes mover, and the constant angle of attack is selected to minimize the force acting on the working surface.

47. An automatic washer according to claim 45 wherein at least one line lying along the working surface and extending between the outer end and the inner end defines a constant angle of attack relative to the direction of movement of the clothes mover, and the constant angle of attack is selected to minimize the force acting on the working surface.

48. An automatic washer according to claim 44 wherein the working surface is one of convex and concave.

49. An automatic washer according to claim 44 wherein the apron is a flat plate.

50. An automatic washer according to claim 44 wherein the apron has a curved cross section.

51. An automatic washer according to claim 50 wherein the curved cross section is in the form of a parabola.

52. An automatic washer according to claim 51 wherein the parabola is one of a $2^{nd}$ order to an $8^{th}$ order parabola.

53. An automatic washer according to claim 52 wherein the parabola is a $4^{th}$ order parabola.

54. An automatic washer according to claim 44 wherein a line extending along the working surface from the lower edge to the upper edge is straight.

55. An automatic washer according to claim 44 wherein a line extending along the working surface from the lower edge to the upper edge is concave.

56. An automatic washer according to claim 44 wherein a line extending along the working surface from the lower edge to the upper edge is convex.

57. An automatic washer according to claim 43 wherein the working surface twists from the outer end to the inner end.

58. An automatic washer according to claim 43 wherein the at least one vane comprises one of two, three, or four vanes.

59. An automatic washer according to claim 58 wherein one of the two or three vanes comprises a first working face in opposed, complementary relationship to a second working face of an adjacent one of another of the two, three, or four vanes.

60. An automatic washer according to claim 59 wherein the first and second working faces have a draft and height selected so that a flow rate between the first and second working faces is instantaneously uniform.

61. An automatic washer for washing garments, comprising:

a wash basket with an open top defining a wash chamber;

a clothes mover provided within the wash chamber, the clothes mover comprising:

an apron mounted for rotation about an axis of rotation and having an upper surface;

at least one vane extending from the apron and defining a working surface having an upper edge and a lower edge, the upper edge and the lower edge extending from an outer end to an inner end, the working surface defining a local draft angle that increases from the outer end to the inner end.

62. An automatic washer according to claim 61 wherein the local draft angle is defined by a first line extending along the working surface from a first point on the lower edge to a second point on the upper edge and a second line extending vertically through the first point.

63. An automatic washer according to claim 61 wherein the local draft angle at the outer end is essentially 0°.

64. An automatic washer according to claim 61 wherein the local draft angle at the inner end is essentially 90°.

65. An automatic washer according to claim 61 wherein the working surface is one of convex and concave.

66. An automatic washer according to claim 61 wherein the working surface twists from the outer end to the inner end.

67. An automatic washer according to claim 61 wherein the at least one vane comprises one of two, three, or four vanes.

68. An automatic washer according to claim 67 wherein one of the two, three, or four vanes comprises a first working face in opposed, complementary relationship to a second working face of an adjacent one of another of the two, three, or four vanes.

69. An automatic washer according to claim 68 wherein the first and second working faces have a draft and height selected so that flow between the first and second working faces is instantaneously uniform.

70. An automatic washer according to claim 61 wherein the apron is a flat plate.

71. An automatic washer according to claim 61 wherein the apron has a curved cross section.

72. An automatic washer according to claim 71 wherein the curved cross section is in the form of a parabola.

73. An automatic washer according to claim 72 wherein the parabola is one of a $2^{nd}$ order to an $8^{th}$ order parabola.

74. An automatic washer according to claim 73 wherein the parabola is a $4^{th}$ order parabola.

75. An automatic washer according to claim 61 wherein a line extending along the working surface from the lower edge to the upper edge is straight.

76. An automatic washer according to claim 61 wherein a line extending along the working surface from the lower edge to the upper edge is concave.

77. An automatic washer according to claim 61 wherein a line extending along the working surface from the lower edge to the upper edge is convex.

* * * * *

UNITED STATES PATENT AND TRADEMARK OFFICE

CERTIFICATE OF CORRECTION

PATENT NO. : 7,628,044 B2
APPLICATION NO. : 11/209370
DATED : December 8, 2009
INVENTOR(S) : Kopyrin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1142 days.

Signed and Sealed this

Second Day of November, 2010

David J. Kappos

David J. Kappos
*Director of the United States Patent and Trademark Office*